US007975434B2

(12) United States Patent
Smith

(10) Patent No.: US 7,975,434 B2
(45) Date of Patent: Jul. 12, 2011

(54) LOCKING LIFT PLATE

(75) Inventor: Peter J. Smith, Newmarket (CA)

(73) Assignee: Magna Closures Inc., Newmarket (CA)

( * ) Notice: Subject to any disclaimer, the term of this patent is extended or adjusted under 35 U.S.C. 154(b) by 360 days.

(21) Appl. No.: 11/577,103

(22) PCT Filed: Oct. 25, 2005

(86) PCT No.: PCT/CA2005/001635

§ 371 (c)(1),
(2), (4) Date: Apr. 12, 2007

(87) PCT Pub. No.: WO2006/045187

PCT Pub. Date: May 4, 2006

(65) Prior Publication Data

US 2009/0007495 A1 Jan. 8, 2009

(51) Int. Cl.
*E05F 11/48* (2006.01)

(52) U.S. Cl. ..... 49/352

(58) Field of Classification Search ..... 49/348, 49/349, 352

See application file for complete search history.

(56) References Cited

U.S. PATENT DOCUMENTS

| | | | | |
|---|---|---|---|---|
| 4,633,613 | A | 1/1987 | Kobayashi | |
| 4,637,166 | A * | 1/1987 | Ujihara | 49/352 |
| 4,648,206 | A | 3/1987 | Moriya et al. | |
| 4,700,508 | A | 10/1987 | Kollner et al. | |
| 4,829,711 | A * | 5/1989 | Sambor | 49/211 |
| 5,009,035 | A | 4/1991 | Kuki et al. | |
| 5,528,861 | A | 6/1996 | Beyerlein | |
| 5,970,658 | A * | 10/1999 | Smith | 49/352 |
| 5,987,819 | A | 11/1999 | Smith | |
| 6,050,029 | A | 4/2000 | Simon et al. | |
| 6,055,778 | A | 5/2000 | Ide et al. | |
| 6,088,965 | A | 7/2000 | Fukumoto et al. | |
| 6,295,762 | B1 | 10/2001 | Nemoto | |
| 6,751,905 | B1 | 6/2004 | Daumal Castello | |
| 6,763,550 | B2 | 7/2004 | Regnier | |
| 6,810,623 | B2 | 11/2004 | Messlez et al. | |

* cited by examiner

*Primary Examiner* — Jerry Redman

(74) *Attorney, Agent, or Firm* — Magna International Inc.; Alex Porat

(57) ABSTRACT

A window regulator that resists backdrive forces directly at the lift plate and rail, rather than by the drive assembly. A locking shoe mounted within the lift plate and selectively frictionally engages the rail while the drive assembly is at rest. Thus, any backdrive forces are transmitted from the window glass to the lift plate, and then directly to the rail, avoiding the drive assembly. A release fork that is coupled to the drive cable automatically disengages the locking shoe when the drive assembly is activated, and engages the locking shoe when the drive assembly disengages.

11 Claims, 4 Drawing Sheets

LOCKING LIFT PLATE

FIELD OF THE INVENTION

The present invention relates to automotive window regulators. More specifically, the present invention relates to a lift plate for a window regulator that resists backdrive forces.

BACKGROUND OF THE INVENTION

Automotive window regulators are required to resist backdrive in order to prevent a partially opened window from being forced down from the outside of the vehicle, such as in a break-in attempt. Current industry practice is to resist backdrive by using a torsion spring clutch in a manual window regulator, and by the electric motor gear ratio in a power window regulator. The disadvantages of both these systems is that the complete window regulator must be robust enough to withstand the backdrive force since the transmitted load path extends all the way from the window glass to the lift plate to the drive assembly (either a manual crank assembly or a power motor). In addition, the traditional methods of resisting backdrive create inefficiencies when the window regulator is operated normally. In a manual system the clutch torque, which could be as
high as 20% of the total operating torque, must be overcome before motion is transmitted to the lift plate. In a power system, single-start worms are required in the motor gearset to ensure suitable backdrive gear efficiency, but single-start worms also create a very low driving efficiency for normal operation of the window regulator.

It is therefore desired to provide a window regulator that resists backdrive in a manner that mitigates or obviates at least one of the above-described disadvantages.

SUMMARY OF THE INVENTION

The present invention provides a window regulator that resists backdrive forces directly at the lift plate and rail, rather than by the drive assembly. A locking shoe is mounted within the lift plate and selectively frictionally engages the rail while the drive assembly is at rest. Thus, any backdrive forces are transmitted from the window glass to the lift plate, and then directly to the rail, avoiding the drive assembly. A release fork that is coupled to the drive cable automatically disengages the locking shoe when the drive assembly is activated, and engages the locking shoe when the drive assembly disengages.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
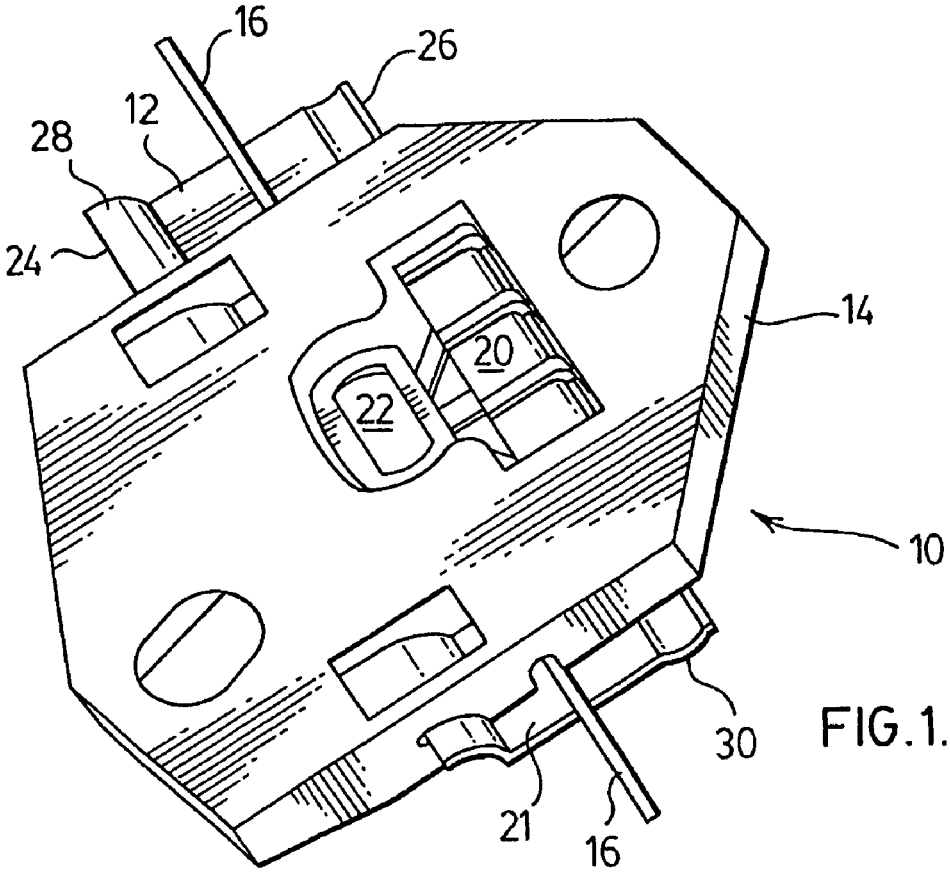
FIG. 1 shows a perspective view of a portion of a window regulator in accordance with an aspect of the invention.

Referring now to FIG. 1, a portion of a window regulator 10 is shown. Window regulator 10 includes a rail 12 that slidably mounts a lift plate 14. Lift plate 14 is operable to traverse rail 12 using a drive cable 16 that is wound around a conventional drive and pulley assembly 18 (not shown). A locking shoe 20 is slidably mounted to rail 12 and retained within a cutout on lift plate 14. Additionally, a nipple housing 22 floats within the cutout on lift plate 14.

Rail 12 is preferably formed from a unitary piece of metal or plastic and can be manufactured by conventional molding, stamping or roll forming techniques. Rail 12 is attached to a substructure (not shown) of a vehicle door frame via conventional fasteners. Alternatively, rail 12 can be attached to or otherwise formed as part of the substrate of a door hardware module. Rail 12 provides an opposing first surface 21 and second surface 23 (not shown), and further includes a parallel first edge 24 and a second edge 26 that run longitudinally along rail 12. An arcuate flange 28 is integrally formed from first edge 24 and curves away from first surface 21 of rail 12, providing a mounting surface for lift plate 14 (described in greater detail below). Proximate to the second edge 26 is a semicircular groove channel 30 that runs parallel to second edge 26.

Lift plate 14 is raised or lowed by drive and pulley assembly 18 (not shown). As known to those of skill in the art, drive and pulley assembly 18 typically includes a pulley mounted at each end of rail 12, and a cable drum mounted to window regulator 10 between the two pulleys, but displaced away from rail 12. Other arrangements of pulleys and cable drums will occur to those of skill in the art, and are within the scope of the invention. For example, the pulleys or the cable drum could be mounted directly to a door hardware module, instead of rail 12. Drive cable 16 is threaded around the cable drum and pulleys, and is described in greater detail below, terminates with a nipple 17 at each end inside nipple housing 22 located within lift plate 14. The cable drum is further coupled to a conventional manual crank system or an electric motor to move the lift plate along rail 12.

Figure 2:
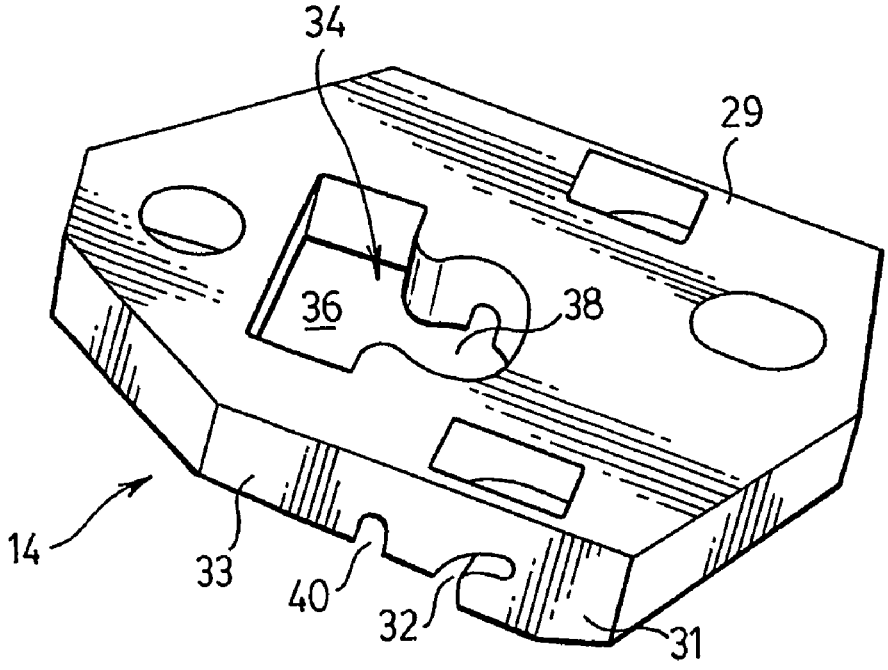
FIG. 2 shows a perspective view of a lift plate located on the window regulator shown in FIG. 1.

Referring now to FIG. 2, lift plate 14 is shown in greater detail. Lift plate 14 is preferably formed from a unitary piece of metal or plastic and can be manufactured by conventional casting or molding techniques. Lift plate 14 is adapted to mount a window glass (not shown) on a first surface 29 using conventional fasteners, tabs or the like. As described earlier, lift plate 14 is slidably mounted to rail 12. An arcuate quadrant slot 32 is provided in an opposing second surface 31 of lift plate 14 and is complementarily fitted over arcuate flange 28. This mounting configuration provides a degree of axial freedom of rotation of lift plate 14 around rail 12 without affecting the locking or unlocking action of lift plate 14 (described in greater detail below). Axial freedom of rotation provides for correct glass tracking and alignment of the window glass with the glass run channels in the door frame (not shown). As mentioned earlier, lifting plate 14 further includes a cutout 34 between first surface 29 and second surface 31. In the current embodiment, cutout 34 includes a generally rectangular area 36 in communication with a generally oval area 38. As can be seen in FIG. 1 and is described in greater detail below, locking shoe 20 is retained against the sidewalls of rectangular area 36 and nipple housing 22 floats more loosely within oval area 38. Two cable passages 40 coaxial with rail 12 extend from opposing side walls 33 of lifting plate 14 into oval area 38 and provide means to thread drive cable 16 through to nipple housing 22.

Figure 3:
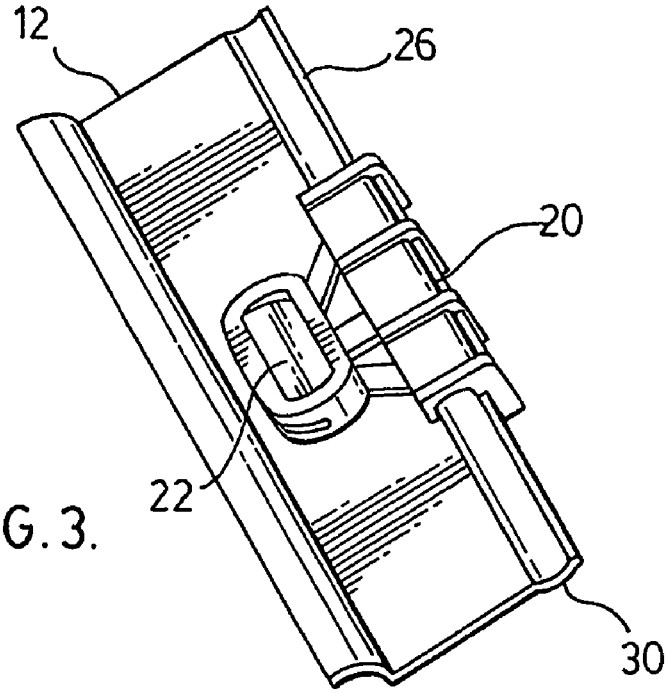
FIG. 3 shows a perspective view of a locking shoe and a nipple housing located on the window regulator shown in FIG. 1.
Figure 4:
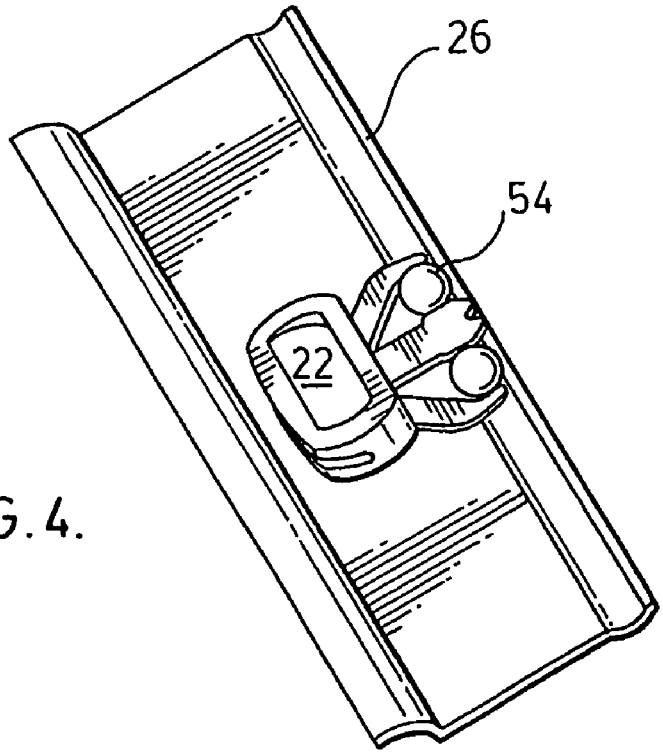
FIG. 4 shows a perspective view of the nipple housing shown in FIG. 3 with the locking shoe removed.
Figure 5:
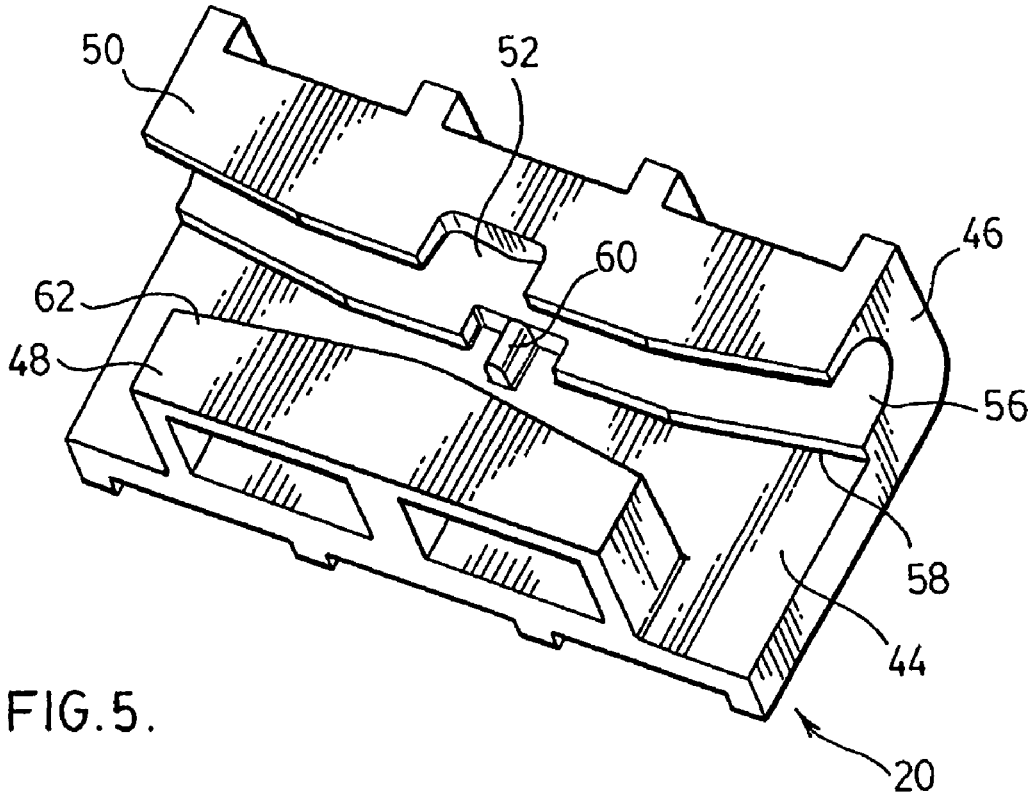
FIG. 5 shows a perspective view of a the locking shoe shown in FIG. 3 from an alternate angle.

Referring now to FIGS. 3 to 5, locking shoe 20 is described in greater detail. Locking shoe 20 is generally 'C shaped' piece of metal or plastic and is fitted over both surfaces of rail 12 at the second edge 26. Locking shoe 20 includes a sidewall 44 that abuts second edge 26 of rail 12, a retaining wall 46 that extends around a portion of first surface 21 that includes groove channel 30, and a retaining wall 48 extending around a portion of second surface 23 that includes the under-surface of groove channel 30. A flange 50 with a central cutout 52 depends from retaining wall 46. Locking shoe 20 is located around the second edge 26 of rail 12 by two resilient balls 54 (FIG. 4) that are retained between groove channel 30 in the rail and two symmetrically oriented grooves 56 formed on the interior surface of retaining wall 46 of locking shoe 20. Preferably, balls 54 are metal bearing. A lip 58 is formed between the edge of grooves 56 and the inner surface of sidewall 44. A fin 60, acting as a fulcrum is integrally formed on the inner surface of sidewall 44 and retaining wall 46 midway between the two grooves 56. Both flanges 50 and lip 58 slope away from first surface 21 on rail 12 as they extend outwards from a centerline defined by central cutout 52 and fin 60. An opposing pair of ramps 62 are situated on the inner surface of retaining wall 48 and provide a reaction force against the underside of groove channel 30 on second surface 23. On each side of fin 60, ramps 62 are sloped inversely to flange 50 and lip 58.

Figure 6:
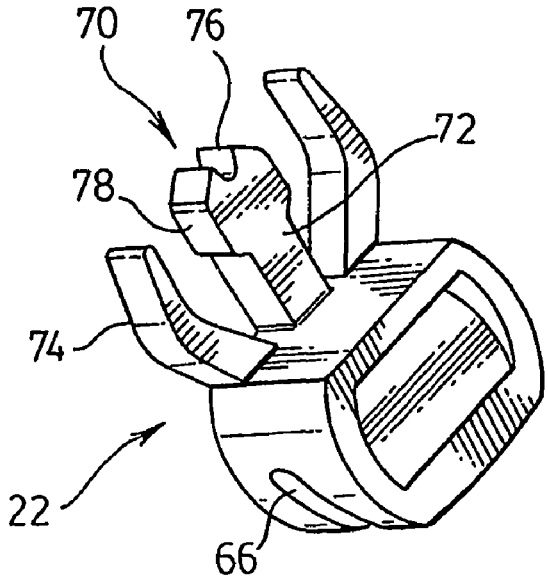
FIG. 6 shows a perspective view of the nipple housing shown in FIG. 4 from an alternate angle.
Figure 7:
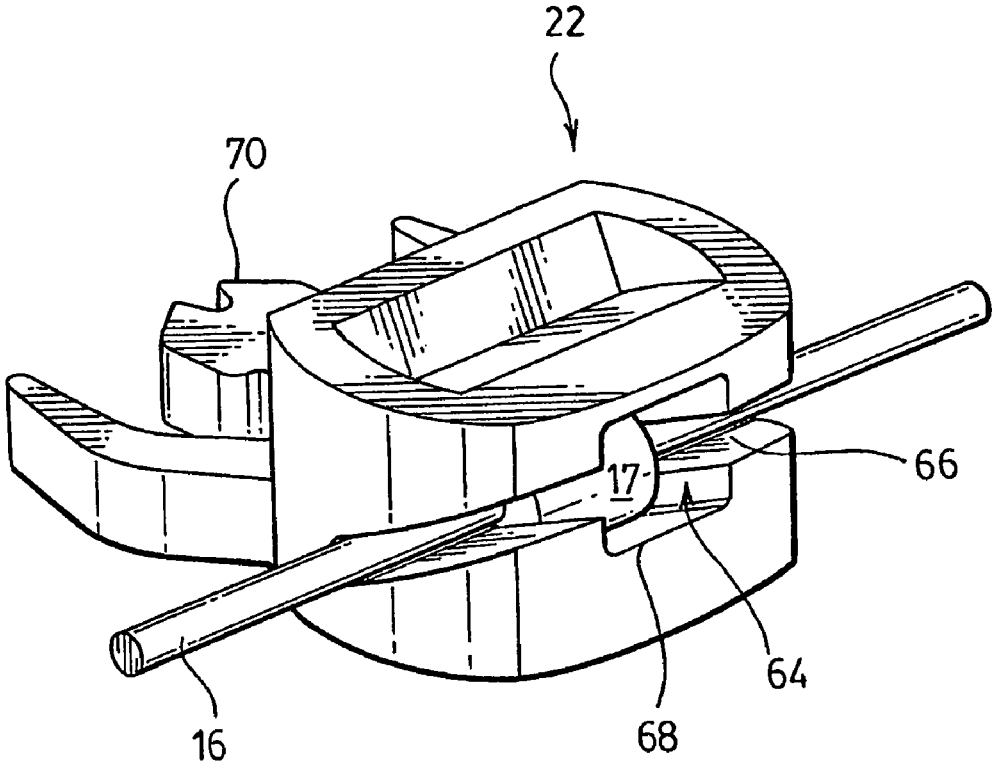
FIG. 7 shows a perspective view of the nipple housing shown in FIGS. 4 and 6 from an alternate angle.

Referring now to FIGS. 4, 6 and 7, nipple housing 22 is described in greater detail. Nipple housing 22 is located in oval area 38 of cutout 34. A chamber 64 provided inside nipple housing 22 is adapted to retain the one or two nipples 17 located at the ends of drive cable 16. A slot 66 is provided in a portion of the sidewalls of nipple housing 22 for drive cable 16 to pass through into chamber 64. Additionally, a gap 68 is provided in the sidewall of nipple housing 22 to fit nipples 17 into chamber 64 through during assembly of window regulator 10.

Floating nipple housing 22 further includes an integrally molded release fork 70. Release fork 70 includes a central finger 72 disposed between two spring fingers 74. The ends of spring fingers 74 are generally parallel to central finger 72. Central finger 72 passes through central cutout 52 into locking shoe 20. A slot 76 on the end of central finger 72 locates nipple housing 22 on fin 60 (FIG. 5) and allows nipple housing 22 to partially pivot there around. The range of pivotal motion of nipple housing 22 is limited by the sidewalls of central cutout 52 in flange 52. Spring fingers 74 abut against lip 58 and urge release fork 70 into a neutral, "locked" position equidistant between the two grooves 56 and perpendicular to the axis of motion in locking shoe 20. Additionally, spring fingers 74 preload spherical balls 54 into full contact with grooves 56 and groove channel 30 when lift plate 14 is stationary, locking lift plate 14. Release fork 70 has two cam faces 78 that are aligned with the longitudinal centerline of groove channel 30 and with the center of balls 54 (FIG. 4). The ratio of the overall length of central finger 72 to the distance from its base against sidewall 46 to the center of cam faces 78 provides a mechanical advantage which reduces the effort required to release spherical balls 54.

The rotation of release fork 70, due to the movement of drive cable 16 locks and unlocks lift plate 14. At rest, lift plate 14 is effectively locked. The relationship between the angle subtended by groove channel 30 on rail 12 and grooves 56 (formed by flange 50 and lip 58) on locking shoe 20, together with the operating coefficient of friction in the locking shoe 20 and rail 12, are such that locking shoe 20 is locked in place to rail 12 by a wedging action by the leading ball 54 generally perpendicular to first surface 21 on rail 12. Backdriving of window regulator 10 is resisted directly at lift plate 14—force is transmitted from the window glass to the lift plate, and subsequently to locking shoe 20. The backdrive force wedges the leading balls 54 between its groove 56 and groove channel 30. The opposing ramp 48 provides a reaction force against the underside of groove channel 30 on rail 12. Force is then transmitted directly to rail 12, and not down drive cable 16 to the drive assembly. A small clearance is provided between cam faces 78 and balls 54 to ensure release fork 70 does not dislodge the locking ball 54.

Lift plate 14 is effectively unlocked by engaging drive and pulley assembly 18. The initial movement of drive cable 16 causes nipple housing 22 to rotate slightly in lift plate 14 around fin 60, bringing the leading cam face 78 of release fork 70 into contact with the leading ball 54. This contact pushes the leading ball 54 out of secure engagement between groove channel 30 and groove 56. At this point, lift plate 14 is still stationary. Continued movement of drive cable 16 then rotates nipple housing 22 further until the leading sidewall of nipple housing 22 comes into contact with the side face of rectangular area 36 on cutout 34 so that nipple housing 22 reacts against lip plate 14. Then, drive cable 16, locking shoe 20, nipple housing, 22 and lift plate 14 then move together as a single unit. Additionally, as nipple housing 22 is rotated around fin 60, the trailing spring finger 74 is restrained by the slope of lip 58 and flange 50, placing the trailing spring finger 74 under tension. When the movement of drive cable 16 stops, the release of tension forces in drive cable 16 and the trailing spring fingers 74 combine to return nipple housing 22 and balls 54 to a locked position between groove channel 30 and grooves 56, as is described above. Only the leading ball 54 needs to be released by release fork 70 as the trailing ball 54 has no influence on the motion of lift plate 14.

The above-described embodiments of the invention are intended to be examples of the present invention and alterations and modifications may be effected thereto, by those of skill in the art, without departing from the scope of the invention which is defined solely by the claims appended hereto.

What is claimed is:

1. A window regulator for moving a window glass in an automotive door, comprising: at least one rail; a lift plate for mounting the window glass, slidably coupled to the at least one rail; a drive assembly for moving the lift plate along a portion of the rail via a cable connected to the lift plate; and means for locking the lift plate at any position along the at least one rail when the drive assembly is not engaged and the cable is not tensioned by the drive assembly, and for enabling motion of lift plate when the drive assembly is engaged and the cable is tensioned by the drive assembly, wherein the means for locking includes a locking shoe slidably mounted to an edge of the at least one rail and movable between a locked state achieved by frictional engagement of the locking shoe with the at least one rail to resist motion by the lift plate, and an unlocked state wherein the locking shoe slides along the edge of the at least one rail, wherein the at least one rail includes: a channel running longitudinally along a first surface of the at least one rail, and the locking shoe extends over the channel, the locking shoe further including a pair of opposing ramps abutting a second surface of the at least one rail; a pair of grooves formed in the locking shoe opposite the channel on the at least one rail; at least one ball located between the inner surface of the locking shoe and the at least one rail; wherein disengaging the drive assembly wedges a leading ball of the at least one ball between the channel and one groove of the pair of grooves to frictionally hold the locking shoe in place on the at least one rail and engaging the drive assembly dislodges the leading ball from between the channel and the one groove to permit the locking shoe to slide along the edge of the at least one rail.

2. The window regulator of claim 1 wherein the lift plate includes a fin on the inner surface of the locking shoe between each groove of the pair of grooves; a nipple housing floating within an cutout in the lift member, the nipple housing being connected to each end of the cable, and having an integrally formed release fork extending out from the nipple housing, pivotally abutting the fin wherein engaging the drive and pulley assembly pivots the release fork partially around the pin so that the release fork dislodges the leading ball from between the channel and the one groove of the pair of grooves, and disengaging the drive and pulley assembly partially pivots the release fork in an opposite direction as to wedge the leading ball between the channel and the one groove.

3. The window regulator of claim 2, wherein the release fork includes a pair of spring arms biasing the release fork equidistant between the two grooves, and a central finger between the pair of spring fingers, and a slot on the end of the central finger that locates the nipple housing around the fin on the locking shoe.

4. A window regulator for moving a window glass, comprising:

at least one rail;

a lift plate for mounting the window glass, slidably coupled to a rail;

a drive assembly;

a cable connected to the drive assembly, said lift plate including a locking shoe having at least one bearing member linearly moveable within the locking shoe, wherein at any position along the rail, the at least one bearing member wedges between the shoe and the rail in response to back-drive forces applied to the window glass to thereby prohibit movement of the lift plate along the rail in the direction of the back-drive force;

said lift plate including an unlocking finger connected to the cable and positioned to dislodge the bearing member from said wedged position upon the tensioning of the cable by the drive assembly and thereby move the lift plate relative to the rail.

5. A window regulator according to claim 4, wherein the bearing member is a ball.

6. A window regulator for moving a window glass installed in an aperture of a vehicle, comprising:

a rail;

a lift plate, slidably coupled to the rail, for mounting the window glass;

a cable connector non-rigidly coupled to the lift plate;

a cable attached to the cable connector;

a drive assembly for tensioning the cable in at least a first direction so as to move the lift plate along the rail in the at least first direction;

a locking shoe, incorporated in the lift plate, which slides along the rail and has a tapered surface relative to the rail; and a bearing member moveably disposed within the locking shoe adjacent the tapered surface thereof;

wherein the cable connector has a locking finger and a unlocking finger, the locking finger holding the bearing member within the locking shoe so as to enable the bearing member to wedge between the tapered surface and the rail and resist an external force applied to the lift plate in the first direction, and the unlocking finger is positioned to dislodge the bearing member from the wedged position when the drive assembly tensions the cable and cable connector to move the lift plate in the first direction.

7. A window regulator according to claim 6, wherein the cable connector is incorporated in a cutout of the lift plate.

8. A window regulator according to claim 7, wherein the locking finger biases the bearing member into a wedged position between the tapered surface and the rail when the drive assembly is disengaged.

9. A window regulator according to claim 6, wherein the locking shoe tapered surface is provided by a tapered groove in the locking shoe and the bearing member is disposed in the groove.

10. A window regulator according to claim 9, wherein the bearing member is a ball.

11. A window regulator according to claim 9, wherein the locking shoe includes a second tapered groove in line with the first groove but tapering in the opposite direction and a second bearing member is disposed in the second groove in order to resist an external force applied to the lift plate in a second direction, opposite the first direction, the cable connector including a second locking finger holding the second bearing member and the unlocking finger dislodges the second bearing member from the wedged position when the drive assembly tensions the cable to move the lift plate in the second direction.

* * * * *